US006152793A

United States Patent [19]

Gongwer

[11] Patent Number: 6,152,793

[45] Date of Patent: Nov. 28, 2000

[54] SCREEN SYSTEM FOR MARINE THRUSTERS

[75] Inventor: Calvin A. Gongwer, Glendora, Calif.

[73] Assignee: Innerspace Corporation, Covina, Calif.

[21] Appl. No.: 09/102,715

[22] Filed: Jun. 22, 1998

Related U.S. Application Data

[63] Continuation-in-part of application No. 09/020,478, Feb. 9, 1998, Pat. No. 5,915,324.

[51] Int. Cl.[7] ..... B63H 1/16

[52] U.S. Cl. ..... 440/67; 114/151

[58] Field of Search ..... 114/151; 440/66, 440/67, 72; 60/221, 222; 52/169.5, 668; 404/4

[56] References Cited

U.S. PATENT DOCUMENTS

| | | | |
|---|---|---|---|
| D. 188,923 | 9/1960 | Gongwer | D17/1 |
| 1,173,568 | 2/1916 | Griffin . | |
| 1,313,946 | 8/1919 | Jenney . | |
| 1,620,129 | 3/1927 | Peterson | 440/72 |
| 2,623,610 | 12/1952 | Buechel | 183/62 |
| 2,695,074 | 11/1954 | Kelly | 183/62 |
| 2,928,497 | 3/1960 | Stockdale | 183/62 |
| 2,983,246 | 5/1961 | Manley | 440/72 |
| 3,343,368 | 9/1967 | Castoldi | 60/221 |
| 3,358,635 | 12/1967 | McRee | 440/72 |
| 3,464,357 | 9/1969 | Duport et al. | 114/151 |
| 3,889,624 | 6/1975 | Balius | 115/42 |
| 4,055,947 | 11/1977 | Gongwer | 60/221 |
| 4,672,807 | 6/1987 | Gongwer | 60/222 |
| 4,726,183 | 2/1988 | Gongwer | 60/221 |
| 4,887,540 | 12/1989 | Gongwer | 114/57 |
| 5,072,579 | 12/1991 | Gongwer | 60/221 |
| 5,127,857 | 7/1992 | Gongwer | 440/79 |
| 5,131,221 | 7/1992 | Shekleton | 60/39.091 |
| 5,176,094 | 1/1993 | Gongwer | 114/61 |
| 5,275,535 | 1/1994 | Gongwer | 416/228 |
| 5,470,262 | 11/1995 | Bustillo | 440/67 |
| 5,540,605 | 7/1996 | Lin | 440/46 |
| 5,915,324 | 6/1999 | Gongwer | 440/72 |

FOREIGN PATENT DOCUMENTS

| | | |
|---|---|---|
| 2344445 | 10/1977 | France . |
| 625522 | 1/1936 | Germany . |
| 674480 | 11/1964 | Italy . |
| 836626 | 6/1960 | United Kingdom . |

*Primary Examiner*—Stephen Avila
*Attorney, Agent, or Firm*—Lyon & Lyon LLP

[57] ABSTRACT

A screen system for marine thrusters is devised having directionally streamlined screens with geometrically-shaped contoured gratings capable of imparting thrust-enhancing effects, thereby permitting high operational efficiency and the ability to operate with little or no reduction in thrust due to cavitation.

18 Claims, 3 Drawing Sheets

SCREEN SYSTEM FOR MARINE THRUSTERS

RELATED APPLICATION DATA

This application is a continuation-in-part of copending U.S. patent application Ser. No. 09/020,478 filed on Feb. 9, 1998, now U.S. Pat. No. 5,915,324 issued Jun. 29, 1999, hereby incorporated by reference as if set forth fully herein.

FIELD OF THE INVENTION

The field of the invention is thruster systems, including more particularly, screens for marine thrusters.

BACKGROUND

Marine vehicles, from large ships to umbilically controlled underwater robots (ROV's) and small submarines, typically use ducted propeller thrusters to control their position and attitude and, except for large ships and some submarines, to provide main propulsion. These thrusters can experience problems not limited to thrust-limiting cavitation at and near the surface, interruption of operations from ingestion of foreign objects, creating hazards to marine life and divers, and excessive screen resistance to flow.

What is needed is a system that addresses these problems while not reducing the thrust or efficiency of the thruster.

SUMMARY OF THE INVENTION

The present invention comprises directionally streamlined screens with geometrically-shaped contoured gratings capable of imparting thrust-enhancing effects, thereby permitting high operational efficiency and the ability to operate with little or no reduction in thrust due to cavitation.

The preferred embodiment of the invention includes two preferably reversible and preferably hexagonal rigid screens. The screens are streamlined for flow in one direction and unstreamlined for flow in the other direction and provide a hydrodynamic advantage to the thruster operation, tending to suppress loss of thrust from cavitation and increase flow efficiency in both directions, notwithstanding the screen's resistance to flow.

Overall thruster performance is enhanced from the interaction of the effects imparted on the flow passing through the thruster. The effects imparted on the flow by the upstream screen and downstream screen accelerates flow velocity of the fluid exiting the duct system while minimizing cavitation effects. The screens may be placed around marine vehicles or propulsion devices, such as those for ROV's and small submarines, to assist positioning, attitude and overall propulsion.

The screens are preferably solid hard-anodized aluminum. The screens can be constructed from other materials, and the contoured cross-sections may also be formed by wrapping sheet metal around a bar screen element.

A further embodiment of the invention includes a bi-directional propeller that rotates in a duct between the screens. The propeller may be of any type of propeller, including straight, or smooth-edged propellers, and orthoskew. Further, the propeller may be reversible without negative effects on the flow since the screens are reversible and properly oriented. The propeller may also be mounted directly to a screen or mounted by bracketry directly to a vessel in a duct or housing formed between the screens.

The screens when made in larger dimensional scales can be applied to large ship transverse thrusters at each end of the tunnel with the same advantages. Also, in a preferred embodiment the screens act as structural support for the propeller shaft and/or drive motor.

DETAILED DESCRIPTION OF THE PREFERRED EMBODIMENT

Figure 1:
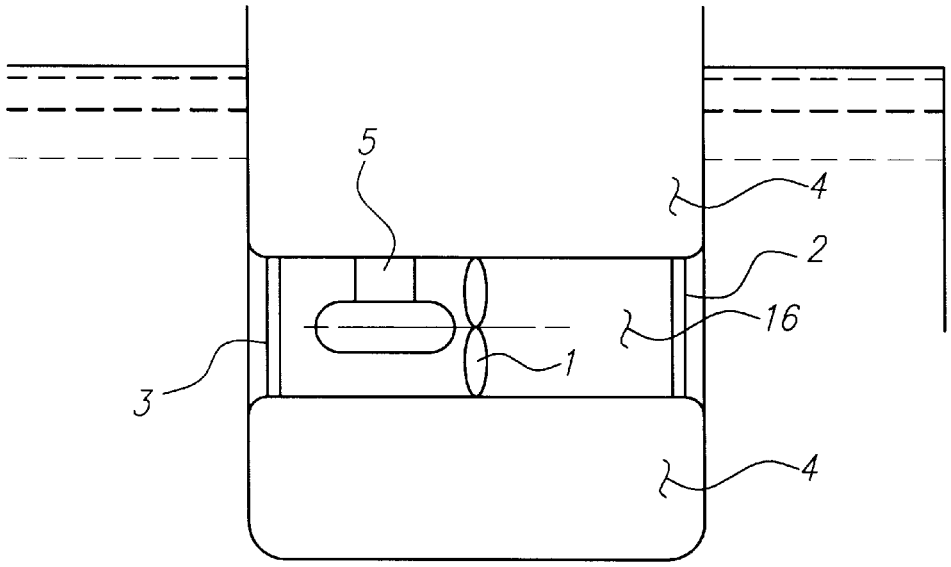
FIG. 1 is a top-view portion of a screen grating within a duct.

Referring to FIG. 1, a representative cross-section of a thruster-screen duct system of the present invention is shown. A thruster is mounted in a duct 16 enclosing a reversible propeller 1 with a pair of contoured streamlined screen elements: a front screen 2 and rear screen 3 in the housing, watercraft body or ship 4. The use of the terms "front" and "rear" are relative terms merely used to facilitate the description of the invention and is by no way intended to limit the scope of the invention. In one operational configuration flow into the duct 16 enters via front screen 2, passes by propeller 1 and exits the duct via rear screen 3. In reverse operation of propeller 1, flow enters the duct system via rear screen 3, passes by propeller 1 and exits the duct system via front screen 2. Because propeller 1 may be reversible, either operational configuration is possible. In a single directional system, either front screen 2 or rear screen 3 may or may not be necessary.

Figure 3:
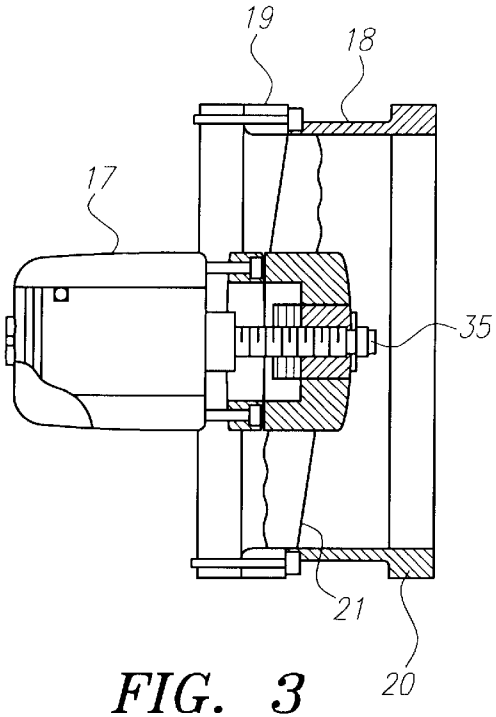
FIG. 3 is a side view of a motor and propeller attached to a propeller housing.

In FIG. 1, propeller 1 is shown mounted by means of mounting bracket 5. FIG. 3 shows a free-standing compact screened thruster system 20 of the present invention that can be mounted to the interior of a duct 16 without the need of the mounting bracket 5. Through the use of the unique rigid motor housing screen 33 and propeller screen 34, the motor housing may be mounted directly to the interior of the duct by housing 18, may be mounted with the housing or may be used without a duct. Thus the free-standing thruster system of FIG. 3 is preferred for use on ROV's (remote operated vehicles) and the like.

Figure 2:
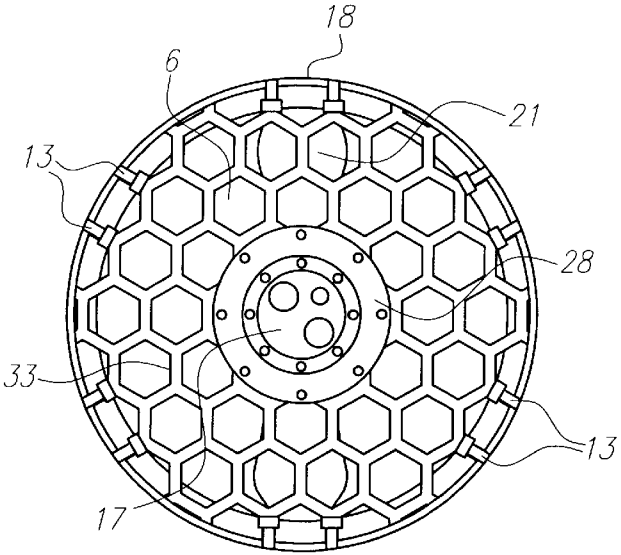
FIG. 2 is an end view of a thruster system.

FIG. 2 is a motor end view of the screened thruster system 37. The housing motor screen 33 is attached to motor housing 17 by means of a motor mounting ring 28. This securely mounts the motor. The motor housing screen 33 is secured around its periphery to a housing 18 either by bolts 13 or if desired permanently attached by welding, mounting brackets or the like at 13. FIG. 2 shows the geometric shaped aperture grating 6 of motor housing 33 to be hexagonal.

Figure 4:
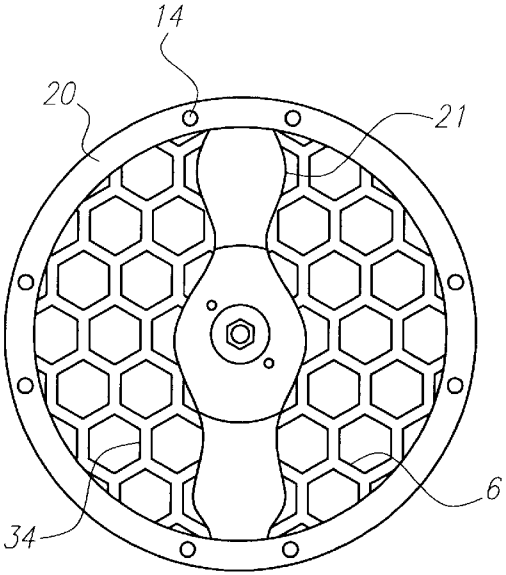
FIG. 4 is an opposite end view of a thruster screen system.

The motor housing screen 33 extends from the motor housing 17 to the end of the housing 18 so that no debris can reach the propeller 1. Hub 35 attaches the propeller 1 to the motor 17. The propeller 1 may be one of many typical reversible propeller configurations including, preferably, the orthoskew propeller described in U.S. Pat. No. 5,295,535 which is incorporated fully herein by reference. However, other straight-edged and contoured propellers would work with the screens. As seen in FIG. 4, which has a portion of the screen 34 cut away, the unique shape of the blades of the orthoskew propeller provides efficient bi-directional thrust.

The propeller screen 34 is shown preferably attached to the housing 18 by bolts 14 spaced around the circumference of housing 18. While the exterior of the housing 18 is shown cylindrical it could be any geometric shape appropriate for the application.

Figure 6:
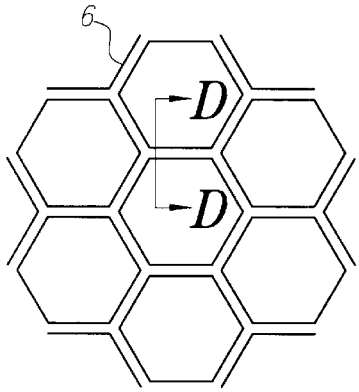
FIG. 6 is a cross-sectional view of a screen grating.
Figure 6A:
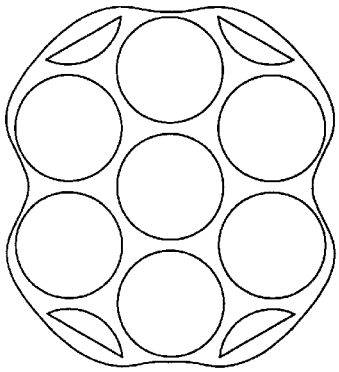
FIG. 6A is a cross-sectional view of a screen grating with circular apertures.
Figure 6B:
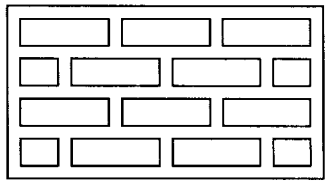
FIG. 6B is a cross-sectional view of a screen grating with rectangular apertures.

The screens 33 and 34 are preferably constructed in the same fashion with the apertures 21 forming the basic building block of the screen as shown in FIG. 6. This shape is preferable as the basic building block for the screen due to the large angle (120 degrees) between intersecting legs of the gratings 6 enclosing the apertures 21. This angle reduces the hydrodynamic interference between the geometric hexagons formed by apertures 21. A screen with square, triangular, circular, rectangular, or other geometrically shaped openings may be preferable in some cases (See FIGS. 6A and 6B).

Figure 5:
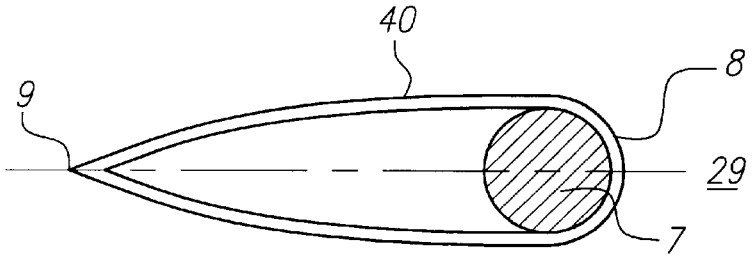
FIG. 5 is a cross-sectional view of a thruster screen.

In cross section, best shown in FIG. 5, the screen has a streamlined shape. As shown in FIG. 5, a cross-section of the screen grating 6 preferably has a tapered end 9 and a contoured end 8. However, to reduce cavitation or eddies caused by the flow of fluids, in some applications it may be more beneficial to have a cross-sectional area wherein both ends are tapered or wherein both ends are contoured.

As previously indicated, the screens are preferably constructed from hard-anodized aluminum. The screens may also be formed by wrapping sheet metal 40 or other appropriate material around a bar screen element 7. FIG. 5 depicts the situation where the cross-sectional area has one end that is tapered and another end 8 that is contoured about a bar screen element 7. The presently most preferable construction of the screens when employed as part of a free-standing thruster system is from cast hard-anodized aluminum.

Figure 7:
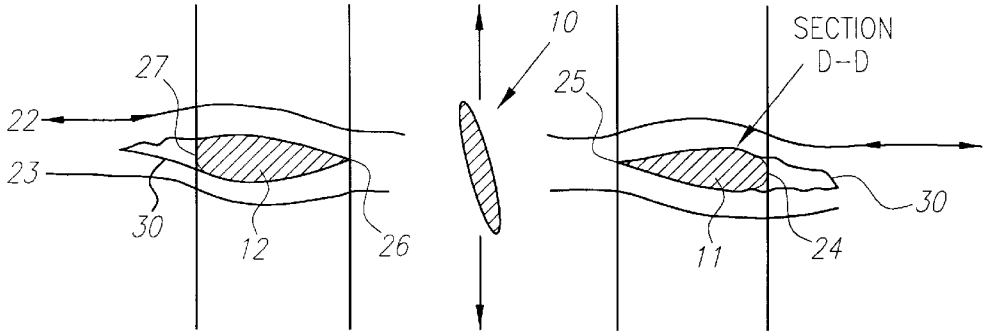
FIG. 7 is a cross-section of a thruster screen system in accordance with the present invention.

The cross-sections shown in FIG. 7 of the gratings 6 of screen 33 and screen 34 are contours 11 and 12. The contours are preferably congruent permitting the screens to be reversible. Contour cross-section 12 is shown having a tapered end 26 and contoured end 27. Contour cross-section 11 is shown having a similar tapered end 25 and a similar contoured end 24. Shown between the cross-sectional contours 11 and 12 is the cross-sectional contour 10 of a propeller 1. As FIG. 7 depicts, the tapered ends 25 and 26 preferably point towards the propeller 1 and the contoured ends 24 and 27 preferably are directed away from the propeller 1. As has been indicated, the screens 33 and 34 can function independently so that a propeller 1 and associated motor housing 17 can be replaced by a ROV device or other underwater device and still impart thrust enhancing effects. As has also been discussed, the cross-sectional contours may have two tapered ends or two contoured ends. The choice of contoured or tapered ends are advantageously selected to reduce formation of eddies 30 and to impart beneficial effects on flow lines represented by 22 and 23. In such cases, the cross-sectional shapes depicted in FIG. 7 would be accordingly modified.

The flow lines 22 and 23 caused by the contoured shape of screens 33 and 34 are streamlined for flow in one direction and unstreamlined for flow in the other direction and provide a hydrodynamic advantage to the overall thruster operation, tending to suppress loss of thrust from a propeller cavitation, or a housing device, and increase propeller efficiency in both directions, notwithstanding the screen's resistance to flow.

By examining the effects imparted on the flow by the various elements in the screen thruster system, the performance enhancements characterizing the present invention can be best described. This description will be done with reference to the compact screened thruster shown in FIGS. 2 through 4. It is to be understood that the same advantages will apply even if the screens are moved further apart, as shown in a duct system 16.

In either the reverse or forward rotation of propeller 1, flow enters the duct via a reversible screen. Because the screens 33 and 34 are each attached such that the tapered ends of the screens face outward in either direction, the fluid flowing into the propeller is subjected to the same flow characteristics and the fluid exiting the propeller are also subjected to the same flow characteristics.

FIG. 7 depicts a cross-sectional view of a screen system, such as the one shown in FIGS. 2 through 4. Since the thruster screen system can by bi-directional, flow can be directed from B-A-C or C-A-B in FIG. 5 along contour flow lines 22 and 23. In either case, it is shown that the tapered end 25 of contour 11 and the tapered end 26 of contour 12 are preferably pointed to propeller contour 10. The contoured end 24 of screen 11 and the contoured end 27 of screen 12 formed into hexagonal-shaped apertures cause the apertures 21 to act as a nozzle, accelerating the flow to the higher velocity of the exit jets and increasing the pressure inside the duct and around the motor, propeller, umbilical cord and so forth. Eddies 30 formed at the contoured ends 24 and 27 are also indicated. The incoming flow to the propeller, shown by a cross-section 10, or other marine device is only slightly restricted since the screen parts are streamlined in this direction.

Figure 8:
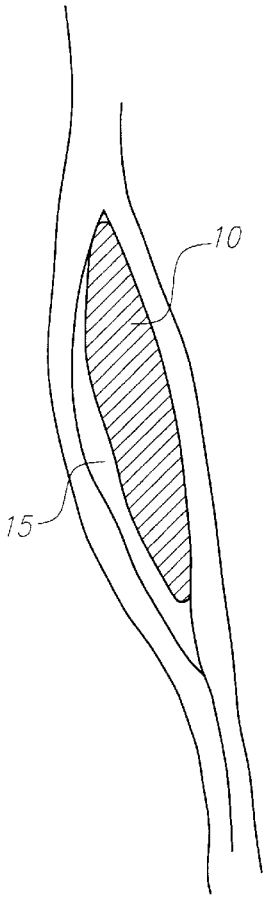
FIG. 8 is a side view of a propeller blade including representative flow lines.

The flow exiting the propeller has a large whirl corresponding to the torque on the propeller or other marine vessel. The flow is also influenced by representative flow lines 38 and 39, shown in FIG. 8. A large portion of this energy of whirl is reclaimed in the exit screen from the thruster screen duct system due to the collimating effect of the screen downstream. The pressure drop across the screens 33 and 34 urges the flow in the axial direction. Due to the square exponent relation between flow velocity and head (meaning the transverse component of the velocity), if the transverse velocity component is reduced by only 50%, 75% of the whirl energy is recovered. This recovery effect helps compensate for the drag of the screens 11 and 12.

The slightly reduced flow rate thru the propeller 1 causes the pressure on the suction side 15 of the propeller blades to increase and thus suppress the cavitation as explained below. The physical picture at breakdown cavitation is shown in the FIG. 8 where the static pressure on the suction side 15 of the propeller blade 10 is essentially zero. The suction side 15 of propeller blade 10 is created by a vapor cavity where the absolute pressure is the vapor pressure of water, virtually zero for cold water. This can be expressed by the Equation (1) which gives the static pressure on the suction side of the propeller blades:

$$\underset{33\,\text{ft}}{\text{Atmospheric pressure}} + \underset{d}{\text{depth in ft}} - (V_p^2)/(2gS) = 0 \tag{1}$$

where $V_p$ is the axial velocity thru the propeller disc and S is the solidity the propeller (the projected blade area as a fraction of the swept disc area). Equation (1) is obtained by applying Bernoulli's theorem to the flow through the thruster inlet from the ambient sea. The slight drop in head thru the inlet screen need not be considered since the screen is streamlined in this direction. $V_p$ is related to the exit velocity out the exit screen by the following:

$$V_p=(V_eA_e)/(A_p) \text{ from continuity,} \quad (2)$$

where $A_e$ and $A_p$ are the flow cross section areas at the exit and propeller disc respectively.

Substituting from (2) into (1):

$$33' + d' - \frac{(V_e^2A_e^2)}{2gS(A_p^2)} = 0 \quad (3)$$

Since the static thrust T is given by the expression:

$$T=\rho V_e^2A_e \quad (4)$$

where ρ is the mass density of sea water, (4) can be substituted into (3) to give the expression for maximum thrust at incipient cavitation breakdown (sometimes called "super cavitation").

Since from (4):

$$V_e^2=T/(\rho A_e) \quad (5)$$

then at the incipient cavitation breakdown condition:

$$T_c=(33+d)2Sg\rho(A_p^2/A_c) \quad (6)$$

Thus, Equation (6) shows that the thrust limit set by cavitation increases as $A_e$ decreases.

The resulting alleviation of the cavitation problem at or near the surface allows the propeller to be designed for maximum efficiency, i.e., higher blade lift coefficients resulting in smaller area and skin friction and higher ratios of pitch to diameter.

The screens can be applied to general purpose propulsion systems such as those found in tugboats where presently large propeller blades provide low efficiencies due to their large wetted areas subject to hydrodynamic skin drag. Large screens would be made preferably from cast stainless steel with round bar elements 7 and with the streamlined fairings 8, as in FIG. 5. The screens when made in large scale can also be applied to large ship transverse thrusters with similar advantages as those discussed herein. Further, due to the strength and stiffness of the screens of this design, at least one or both of them can be used to support the propeller and its drive motor. This eliminates struts normally required.

What is claimed:

1. A thruster screen system comprising:

at least one screen, said at least one screen comprising a mounting portion and a grating, said grating comprising a plurality of apertures, each of said apertures having a longitudinal axis, said apertures having a first opening and a second opening, wherein each of said second openings lie in a plane substantially perpendicular to said longitudinal axis, wherein said second opening defines a nozzle that directs flow in a direction substantially normal to said plane, wherein said flow is substantially laminar, and wherein at least one of the plurality of apertures has a hexagonal shape.

2. A thruster screen system comprising:

at least one screen, said at least one screen comprising a mounting portion and a grating, said grating comprising a plurality of apertures, each of said apertures having a longitudinal axis, said apertures having a first opening and a second opening, wherein each of said second openings lie in a plane substantially perpendicular to said longitudinal axis, wherein said second opening defines a nozzle that directs flow in a direction substantially normal to said plane, wherein said flow is substantially laminar, and wherein said grating of said screen is formed by a circular bar wrapped by a metallic sheet.

3. A thruster screen system comprising:

a housing having a first open end and a second open end, said housing defining a chamber between said first and second open ends;

a first screen, said first screen comprising a mounting portion and a grating, said grating comprising a plurality of apertures, each of said apertures having a longitudinal axis, said apertures having a first opening and a second opening, wherein each of said second openings lie in a plane substantially perpendicular to said longitudinal axis, and wherein said second opening defines a first nozzle that directs flow in a direction substantially normal to said plane, wherein said flow is substantially laminar, said first screen attached to said first open end of said housing;

a second screen, said second screen comprising a mounting portion and a grating, said grating comprising a plurality of apertures, each of said apertures having a longitudinal axis, said apertures having a first opening and a second opening, wherein each of said second openings lie in a plane substantially perpendicular to said longitudinal axis, and wherein said second opening defines a second nozzle that directs flow in a direction substantially normal to said plane, wherein said flow is substantially laminar, said second screen attached to said second open end of said housing; and a thruster, said thruster attached to said housing between said first screen and said second screen.

4. A thruster screen system as in claim 3, wherein said thruster is bi-directional.

5. A thruster screen system as in claim 3, wherein said thruster has a propeller.

6. A thruster screen system as in claim 3, wherein at least one of said plurality of apertures of said first screen has a circular shape, and wherein at least one of said plurality of apertures of said second screen has a circular shape.

7. A thruster screen system as in claim 3, wherein at least one of said plurality of apertures has a rectangular shape and wherein at least one of said plurality of apertures of said second screen has a rectangular shape.

8. A screen system, comprising:

a first screen, said first screen comprising a grating, said grating comprising a plurality of apertures, each of said apertures having a longitudinal axis, said apertures having a first opening and a second opening, wherein each of said second openings lie in a plane substantially perpendicular to said longitudinal axis, and wherein said second opening defines a first nozzle that directs flow in a direction substantially normal to said plane, wherein said flow is substantially laminar;

a second screen, said second screen comprising a grating, said grating comprising a plurality of apertures, each of said apertures having a longitudinal axis, said apertures having a first opening and a second opening, wherein each of said second openings lie in a plane substantially perpendicular to said longitudinal axis, and wherein said second opening defines a second nozzle that directs flow in a direction substantially normal to said plane; and a housing capable of mounting said first and said second screens, said housing having a first end and a second end, said first screen mounted at said first end, said second screen mounted at said second end.

9. The screen system of claim 8, wherein said housing is capable of attaching said screen system to a vessel.

10. The screen system of claim 8, further comprising a thruster, said thruster attached to said housing and positioned between said first and second screens.

11. The screen system of claim 8, wherein said grating of said first screen and said grating of said second screen are formed by a circular bar wrapped by a metallic sheet so that a first end of said grating is tapered and a second end of said grating is rounded.

12. The screen system of claim 8, wherein at least one of the plurality of apertures on said first screen has a hexagonal shape, and wherein at least one of the plurality of apertures on said second screen has a hexagonal shape.

13. A directional thruster system, comprising:

a first screen having a periphery and having a first grating that forms geometrically shaped inlets for flow, said grating contoured with a rounded end and a tapered end, said first grating defines a nozzle that directs flow in a direction substantially normal to said first grating, wherein said flow is substantially laminar;

a second screen having a periphery and having a second grating that forms geometrically shaped inlets for flow, said grating contoured with a rounded end and a tapered end, said second grating defines a nozzle that directs flow in a direction substantially normal to said second grating, wherein said flow is substantially laminar;

said first and second screens positioned so that said tapered side of said first grating faces said tapered side of said second grating;

a first clip attached to said periphery of said first screen;

a second clip attached to said periphery of said second screen; and a housing capable of attaching to said first and second clips so that said first and said second gratings are enclosed by said housing.

14. The directional thruster system of claim 13, wherein said directional thruster system is reversible.

15. The directional thrusters of claim 13, wherein said first and second clips are mounting brackets capable of attaching said first screen and said second screen to said housing.

16. A directional thruster screen system comprising:

a first screen having a periphery and having a first grating that forms geometrically shaped inlets for flow, said first grating contoured with a rounded end and a tapered end, said first grating defines a nozzle that directs flow in a direction substantially normal to said first grating, wherein said flow is substantially laminar;

a first screen bracket attached to said periphery of said first screen, said first screen bracket capable of attaching to the underside of a water craft;

a second screen having a periphery and having a second grating that forms geometrically shaped inlets for flow, said second grating contoured with a rounded end and a tapered end, said second screen positioned so that said tapered end of said second grating faces said tapered end of said first grating, said second grating defines a nozzle that directs flow in a direction substantially normal to said second grating, wherein said flow is substantially laminar; and a second screen bracket attached to said periphery of said second screen, said second screen bracket capable of attaching to the underside of said water craft;

said first and second screen brackets adapted to attach to a duct, said duct having opposite ends and having a top and a bottom surface, said bottom surface formed by a bottom sheet, said top surface defined by said undersurface of said watercraft, one end of said duct defined by said first screen with said tapered end of said first screen facing into the duct, and an opposite end of said duct defined by said second screen with said tapered end of said second screen facing into the duct, said bottom sheet attached to said first and second screen brackets.

17. The directional thruster of claim 16, wherein said geometrically shaped inlets of said first grating are hexagonally shaped, and said geometrically shaped inlets of said second grating are hexagonally shaped.

18. A thruster screen system comprising:

at least one screen, said at least one screen comprising a mounting portion and a grating, said grating comprising a plurality of apertures, each of said apertures having a longitudinal axis, said apertures having a first opening and a second opening, wherein each of said second openings lie in a plane substantially perpendicular to said longitudinal axis, wherein said second opening defines a nozzle that directs flow in a direction substantially normal to said plane, wherein said flow is substantially laminar, and wherein at least one of the plurality of apertures has a circular shape.

* * * * *